United States Patent [19]

Zelenka

[11] Patent Number: 4,725,097

[45] Date of Patent: Feb. 16, 1988

[54] INCLINED CUTTER FOR SURFACE CLEANING HEAD

[75] Inventor: Frank Zelenka, Rexdale, Canada

[73] Assignee: Bartell Industries Limited, Weston, Canada

[21] Appl. No.: 708,653

[22] Filed: Mar. 6, 1985

[51] Int. Cl.[4] ..... E01C 23/08

[52] U.S. Cl. ..... 299/39; 125/5; 299/40

[58] Field of Search ..... 299/39, 40, 71, 78, 299/85, 86; 51/176; 175/338; 125/5; 404/90, 91

[56] References Cited

U.S. PATENT DOCUMENTS

| | | | |
|---|---|---|---|
| 2,664,281 | 12/1953 | Luksch et al. | 299/39 |
| 3,156,231 | 11/1964 | Harding, Jr. | 173/24 X |
| 3,309,729 | 3/1967 | Dresser | 125/5 |
| 4,175,886 | 11/1979 | Moench et al. | 404/90 |
| 4,275,928 | 6/1981 | Jackson | 299/39 |
| 4,591,108 | 6/1986 | Svendsen | 125/5 X |
| 4,640,553 | 2/1987 | Zelenka | 299/39 |

FOREIGN PATENT DOCUMENTS

| | | | |
|---|---|---|---|
| 1459702 | 2/1969 | Fed. Rep. of Germany | 404/90 |
| 606973 | 8/1948 | United Kingdom | 299/86 |

*Primary Examiner*—Stephen J. Novosad
*Assistant Examiner*—David J. Bagnell
*Attorney, Agent, or Firm*—Sim & McBurney

[57] ABSTRACT

In apparatus for removing material from the surface of a solid substrate, a rotary cutter cage has a plurality of cutters where each cutter has a plurality of projecting cutter teeth. The improvement comprises an adaptation in mounting of the cutters on the cutter rotary cage to force a lateral movement in the cutters when they impact a solid substrate being treated during rotation of the rotary cutter cage.

15 Claims, 13 Drawing Figures

INCLINED CUTTER FOR SURFACE CLEANING HEAD

FIELD OF THE INVENTION

This invention relates to surface treatment equipment for removing a layer of the surface, and in particular, rotary cutter cages having a plurality of cutters for impacting the surface to the treated.

BACKGROUND OF THE INVENTION

It is often desirable to remove a layer from a solid substrate such as concrete pavement, metal decks, fibreglass decks, and the like, so as to prepare the surface for a subsequent finish coating such as painting, sealing, or retopping. A hand operated concrete surface treatment apparatus is disclosed in U.S. Pat. No. 3,156,231. The rotary cutter cage for the apparatus carries a plurality of star-shaped cutter elements. During rotation of the cutter cage, the cutter elements impact the concrete surface to chip away a layer from the surface. A larger self-propelled surface conditioning machine is disclosed in U.S. Pat. No. 3,266,846. The apparatus includes a rotary cutter cage having several cutter elements. The cutter cage is rotated and transported across the surface to be treated to remove a layer of material from the surface. U.S. Pat. No. 4,275,928 discloses a rotary cutter cage for surface treating apparatus where the individual cutters are provided with carbide tipped teeth. The individual cutters are mounted on circular bars where each cutter element has a cylindrical bore extending therethrough and in a direction perpendicular to the plane in which the cutter teeth lie. In U.S. Pat. No. 4,040,668 a rotary cutter cage is provided having cutter elements with an elongate bore formed therein to provide for a prolonged impact of the cutting element on the surface being treated.

A floor roughing machine is disclosed in U.S. Pat. No. 1,964,746. The machine includes a rotary cutter cage having a plurality of cutters mounted on the cage. The bore extending through each cutter element is considerably larger than the bar on which it is mounted. This provides for a loose independent play in each cutter while being held yieldably outwardly by centrifugal force developed during rotation of the cutter cage. In use, the cutter cage is rotated at speeds of approximately 400 to 800 rpm. Each cutter member impacts the floor slightly in advance of its point of lowest travel and thereafter resumes its outermost position on the cage. The bore through each of the cutters is cylindrical and has a central axis extending in a direction perpendicular to the plane in which the cutter teeth lie. Should a reduced number of cutters be mounted on the cutter cage, sufficient space is provided between the cutter disks to allow tilting of each disk, so that a disc may slide off a hard spot and cut into a softer one. Accordingly, a continued use of the cutters in this arrangement tends to round the edges of the bore of each cutter. However, the central portion of the bore remains cylindrical with an axis perpendicular to the plane in which the cutter teeth lie.

In the cleaning and grooving of cracks in surfaces, U.S. Pat. No. 2,664,281 discloses a cutter arrangement which provides for tilting of the individual cutter element. The system is particularly adapted for removing material from grooves in concrete. The cutter has a central bore substantially larger than the bar in which it is mounted. This permits freedom of movement in the cutter to move radially and trans-radially as well as tipping when a lesser number of spacer washers are used. This allows the machine to follow cracks in concrete when gouging them out for resealing.

In principle, all of the surface conditioning machines, as common to the above-discussed prior art, rely on the cutter elements impacting the surface with the cutter teeth lying in a plane essentially perpendicular to the plane of the surface. Thus, the cutter teeth of each cutter element on the cutter cage impact the surface straight on, thereby having to overcome the resistance of concrete and other surfaces to chipping caused by compressive forces.

SUMMARY OF THE INVENTION

In accordance with an aspect of this invention, an improvement is provided in an apparatus for removing material from the surface of a solid substrate. The apparatus comprises a support frame, a rotary cutter cage, means for mounting the rotary cutter cage on the frame and means for rotating the cutter cage about a central axis. The rotary cutter cage has at least one row of a plurality of cutters mounted thereon for impacting a solid substrate. The at least one row of cutters is mounted on a bar connected to the rotary cage. The bar is spaced from and extends parallel to the central axis. Each of the cutters has a plurality of projecting cutter teeth and the cutters mounted loosely on the bar. The improvement comprises means on each of the cutters for forcing a lateral movement in each of the cutter teeth in a direction when the cutters impact a solid substrate being treated during rotation of the cutter cage in use of said apparatus.

According to another aspect of the invention a cutter is provided for use on a rotary cutter cage of an apparatus for removing material from a surface of a solid substrate. The cutter comprises a body portion with a bore extending therethrough to receive and be mounted loosely on a bar connected to the rotary cutter cage. The body portion carries a plurality of outwardly projecting cutter teeth. The cutter has means for effecting a lateral movement of the cutter teeth when the cutter is in use on a rotary cutter cage.

BRIEF DESCRIPTION OF THE DRAWINGS

Preferred embodiments of the invention are shown in the drawings wherein.

DETAILED DESCRIPTION OF THE PREFERRED EMBODIMENTS

Figure 1:
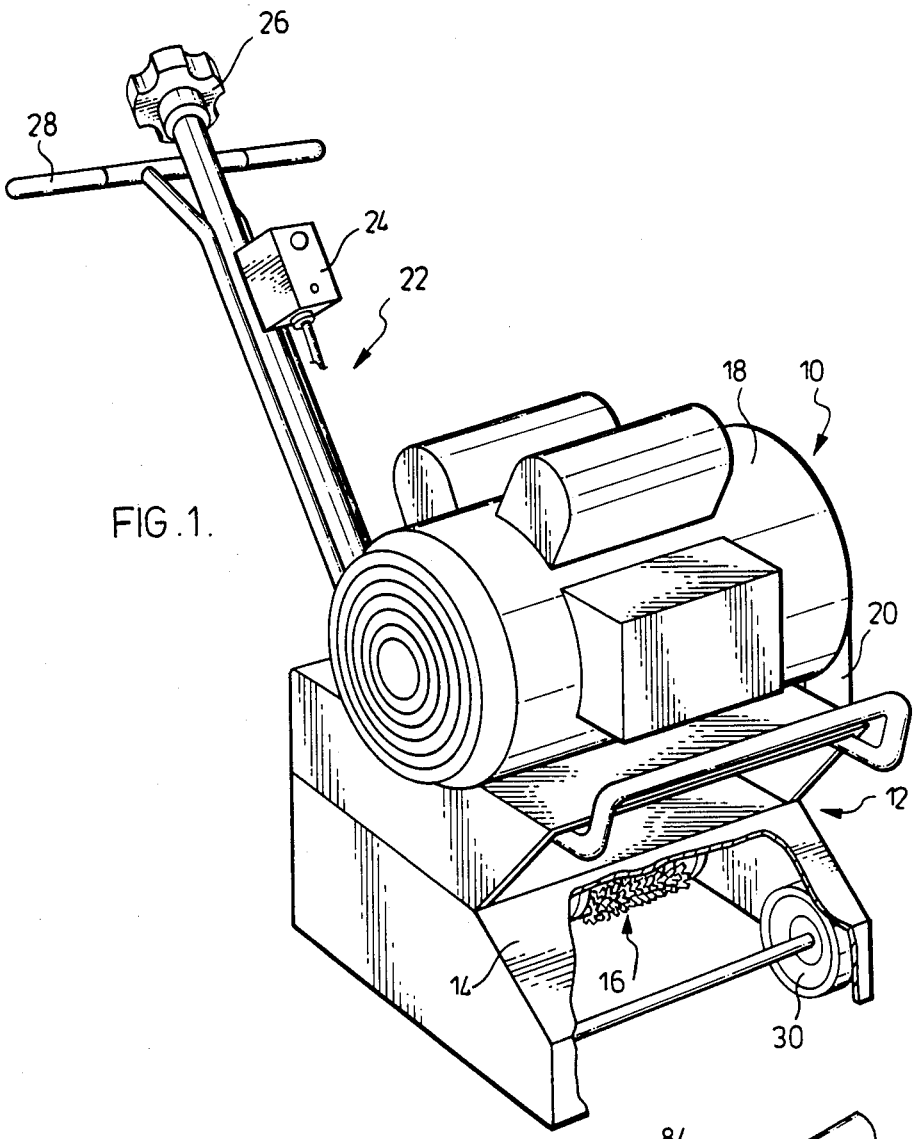
FIG. 1 is a perspective view of a mobile apparatus for removing material from the surface of a solid substrate.

The apparatus 10 of FIG. 1 has a support frame generally designated 12 with housing 14 for a rotary cutter cage 16 mounted within and on the frame. A motor 18 drives the rotary cutter cage through a belt drive housed within belt housing 20. A handle 22 with control switch 24 is mounted to the rear of support frame 12. A height adjustment knob 26 is provided conveniently at the upper portion of the handle 22 to allow the operator to adjust the height of the rotary cutter cage relative to the surface to be treated. Not shown in FIG. 1 are hinged wheels at the rear of the support frame which operate in conjunction with the front wheels 30 mounted to the housing 14. This system allows the operator, by adjusting knob 26, to vary the height of the rotary cutter cage relative to the surface to be treated, and thereby vary the depth of the layer to be removed from the solid substrate.

Figure 3:
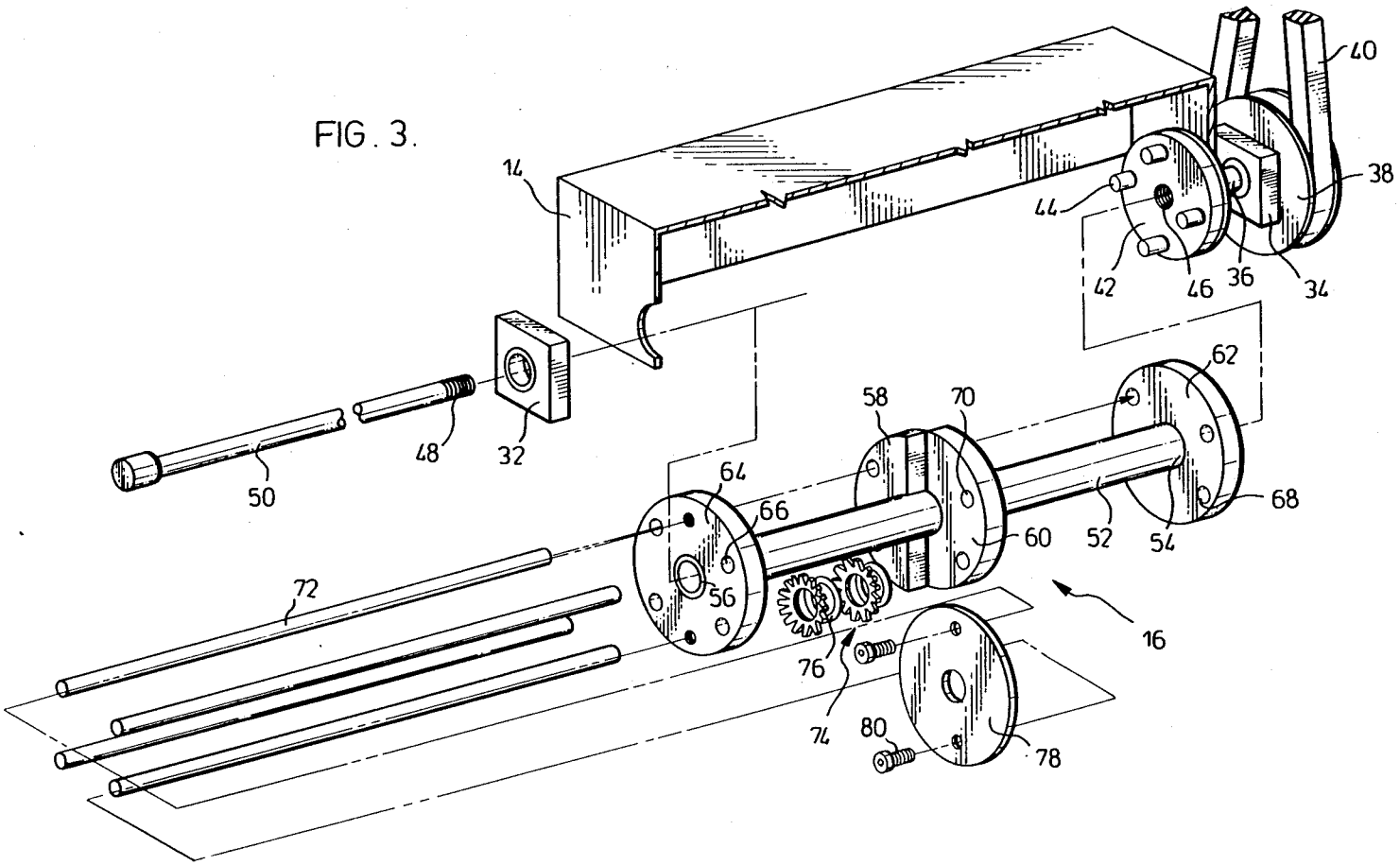
FIG. 3 is an exploded perspective view of the rotary cutter cage of the apparatus of FIG. 1.

Various embodiments are provided for the cutter elements mounted on the rotary cutter cage 16 to cause a lateral movement in the cutters of the rotary cutter cage when the cutters impact the surface. With reference to FIG. 3, the housing 14 has bearing blocks 32 and 34 mounted at each end of housing 14. A shaft 36 extends through block 34 to which a drive pulley 38 is keyed and driven by drive belt 40 housed within belt housing 20. Mounted to the other end of shaft 36 is a drive hub 42 having four outwardly extending drive pins 44 equally spaced about the hub 42. Centrally of the hub 42 is a threaded bore 46 which receives the threaded end 48 of a connecting rod 50 of the rotary cutter cage.

The rotary cutter cage 16 has a central axle 52, which is hollow and open-ended at each end 54 and 56. Centrally of the axle 52 is mounted a pair of semi-circular segments 58 and 60. At each end of the cutter cage 16 are end plates 62 and 64. In end plate 62 are blind end holes 68 and in plate 64 are apertures 66. Correspondingly in segments 58 and 60 are apertures 70. The apertures 66, 68 and 70 are aligned with one another to receive the four carrier bars 72 which extend through the aligned apertures to be supported by the end plates 62, 64 and the central segments 58 and 60. As the bars 72 are passed through the apertures, cutter elements 74 and spacer washers 76 are assembled on the bar 72. With the bars in place and all cutter elements assembled thereon to provide a complete cutter cage 16, the bars 72 are secured in place by way of an end plate 78 which is secured to the outside of plate 64 by Allen screw fasteners 80.

The outer side of end plates 62 includes four apertures to receive the drive pins 44. Thus the assembled rotary cutter cage is positioned on the drive pins 44 and connector bar 50 is passed through bearing 32 and threaded into aperture 46 of drive hub 42. This completes the assembly of the rotary cutter cage onto the drive system. At the same time, this method of assembly for the cutter cage provides for quick removal of the cutter cage, should replacement of the cutter elements be required, or the installation of another cutter cage having different types of elements is desired. This provides for a variety of uses for the surface treating apparatus while only requiring different sets of cutter elements.

Figure 2:
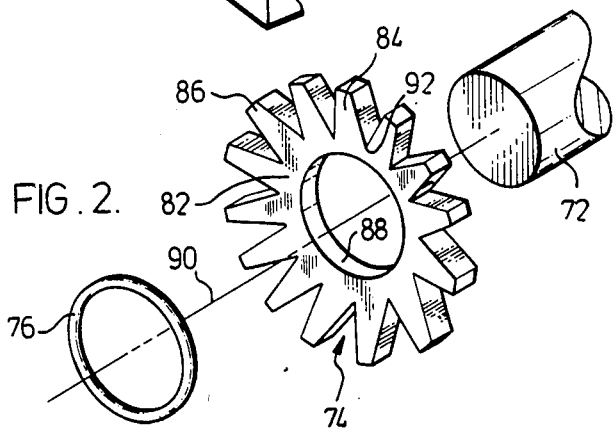
FIG. 2 is a perspective view of a cutter element for use on a rotary cutter cage mounted within the apparatus of FIG. 1.

In accordance with an embodiment of FIG. 2, a cutter element 74 is in the shape of a star having a body portion 82 with outwardly projecting teeth 84 having hardened cutter tips 86. A cylindrical bore 88 extends through the body portion 82 where the cutter tips 86 are symmetrical about the central axis 90. The bore 88 is larger than the rotary cutter cage carrier bar 72. According to this embodiment, the bar 72 is circular and has a diameter less than the diameter of the bore 88. The spacer ring 76 which may be a metal O-ring has an internal diameter slightly greater than the diameter of the bar 72 where the outer diameter of the ring 76 does not exceed the radial extent of the base portion 92 of the cutter teeth. This arrangement allows lateral movement of the cutter teeth 86 when the cutter element 74 impacts the surface to be treated. The width of the metal O-ring in spacing apart adjacent cutters precludes one of the cutters interfering with a tilting movement of an adjacent cutter when the cutter teeth move laterally.

Figure 5:
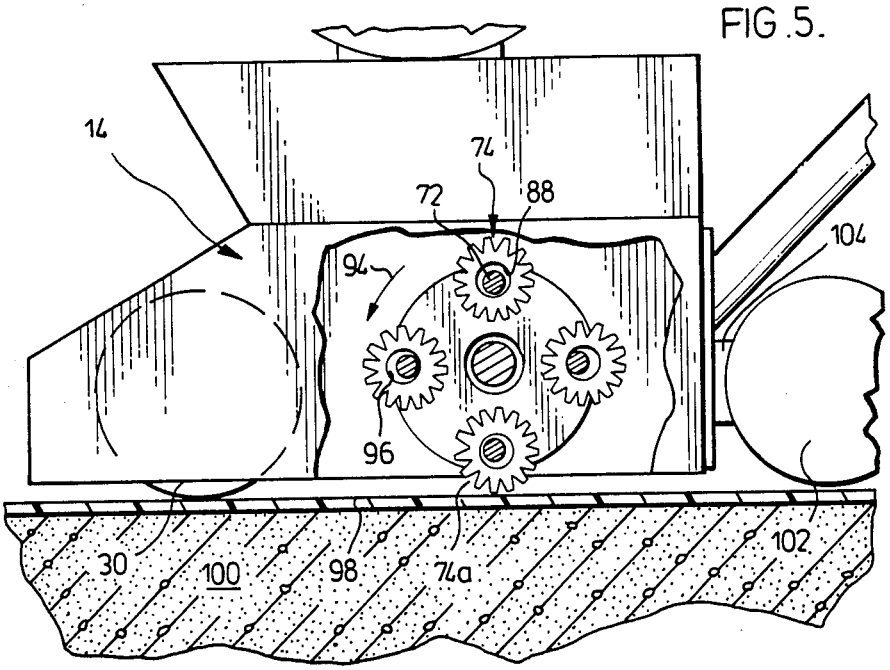
FIG. 5 is a partial side elevation of the apparatus of FIG. 1 with a portion removed to show the cutter elements mounted on the cutter cage.

With reference to FIG. 5, the difference in diameters between the bore 88 of each cutter element 74 and the diameter of the carrier bar 72 is shown. The rotary cutter cage rotates in the direction of arrow 94 due to the centrifugal force of the cutter element 74. The space 96 developed between the bore of each element and the bar circumference is located outwardly of the corresponding bar. Cutter element 74*a* is shown as impacting the surface 98 of the solid substrate 100. The cutter 74*a* is demonstrated as being raised slightly from its outermost position on the carrier bar 72. The depth to which the cutter 74*a* will cut into the surface 78 of the substrate is determined by the positioning of the front wheel 30 and the rear wheel 102. The adjustment knob 26 can vary the height of the wheel 102 by swivelling carrier arm 104 relative to the frame structure 14. As the rear wheel 102 is swung upwardly relative to the frame 14 to lower the frame towards the surface 98, the respective carrier bar 72 is lowered so as to press the cutter element 74*a* into the surface after it has impacted it by an interaction of the carrier bar against the lower portion of the bore 88.

Figure 4:
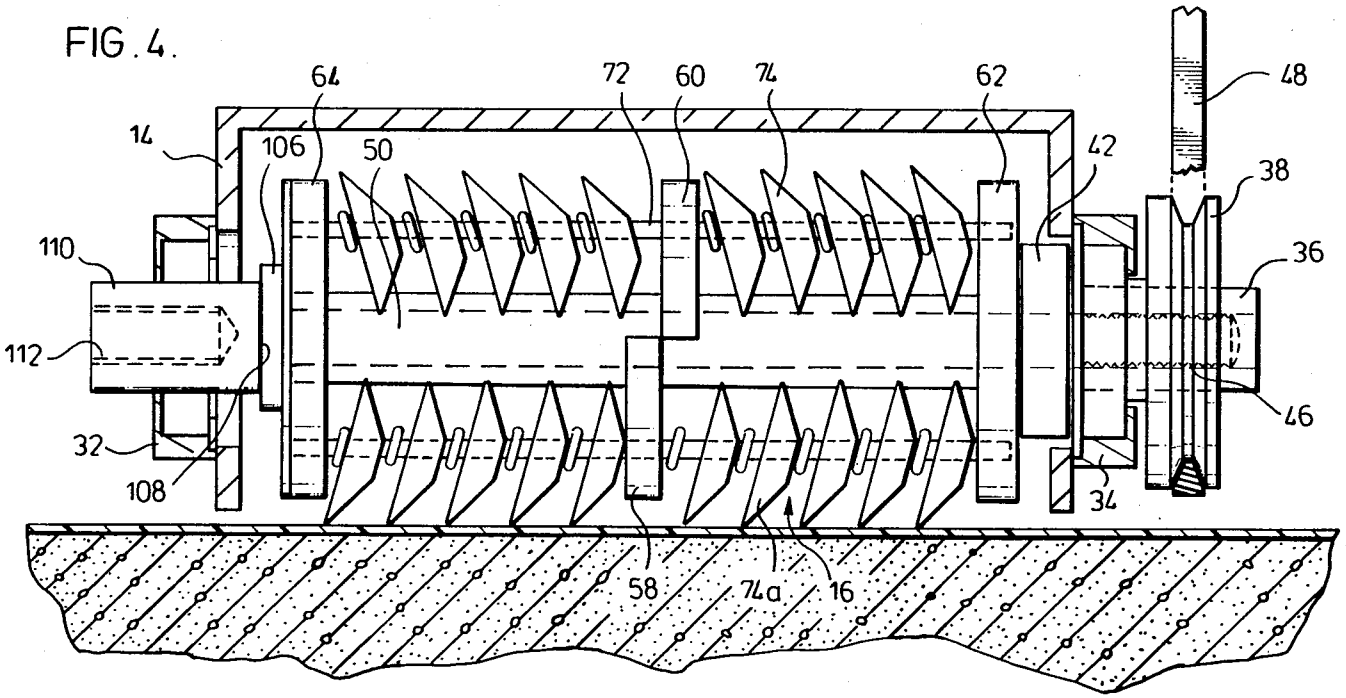
FIG. 4 is a section through the rotary cutter cage as mounted on the apparatus of FIG. 1.

Referring to FIG. 4, the assembled rotary cutter cage 16 is illustrated in detail. The connector rod 50, as explained, is threaded into the bore 46 of the drive hub 42. The inner face 108 of the enlarged head portion 110 of the connector rod 50 clamps the end plates 62 and 64 between the drive hub 42 and the spacer washer 106. The thread direction of threaded bore 46 is such to ensure tightening of rod end 48 in the bore 46 during operative rotation of the cutter cage. A recess 112 is provided in head 110 to permit use of an Allen wrench to initially tighten the rod 50. The segments 58 and 60 are provided centrally of the rotary cutter cage 16 to lend support to the carrier rods 72 to avoid stress cracking in the rods during the abuse to which they are subjected in chipping at hard materials such as concrete. The rotary cutter cage includes four carrier rods 72 and thus provides four rows of cutters across the width of the entire cutter cage. The support segments 58 and 60 are offset to ensure that the cutters of one row overlap the space between the next row of cutters in the central region. As generally shown in FIG. 4, the upper row of cutters 74 all slant in a first direction, whereas the bottom row of cutters impacting the surface slant in an opposite direction.

Figure 7:
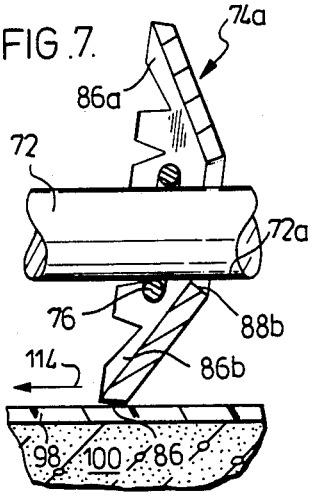
FIG. 7 shows the lateral movement of each cutter element upon impacting the surface.
Figure 6:
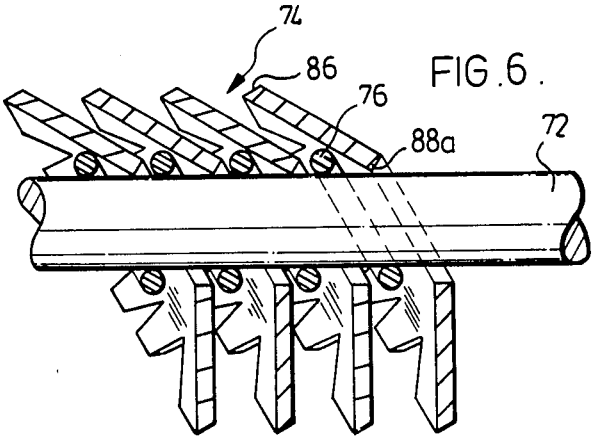
FIG. 6 generally illustrates the position of the cutter elements on the cutter cage under the influence of centrifugal force exerted on the cutter elements.

With reference to FIGS. 6 and 7, the action is demonstrated in more detail. As shown in FIG. 6, the upper edge of the bore 88*a* is contacting the carrier bar 72. Assuming centrifugal force is acting on the individual cutters 74, the cutters will tend to slope in the direction shown in FIG. 6, because the cutter teeth 86 lie in a plane offset laterally of the bore contact point 88*a*. Due to the mass of the concave shaped plate for the star-shaped cutter, the cutter tends to pivot about contact point 88*a* so that the individual cutters tilt generally in the direction shown in FIG. 6. The O-ring spacers 76 may be loose fitting on the bar. This loose fit for the spacers may permit a slight tilting in accommodating the overall tilting of the adjacent cutters.

The provision of a concave or dished shape for each of the cutter elements 74 causes a lateral movement of the cutter teeth 86 during impacting of the cutter elements with the surface 98 of the solid substrate. It has been found that the best circumferential speeds for operating the cutter cage are in the range of 1,800 to 3,000 feet/minute. At these speeds it is difficult to properly ascertain what is happening with the cutter teeth 86 when they impact a surface. However, based on the results of wear patterns on the cutter teeth, it is realized that the teeth are moving generally in the direction of arrow 114 during impact or at least on initial impact with the solid substrate. The bottom portion 72*a* of the carrier rod is contacting the bottom of the bore portion at 88*b* after the cutter 74*a* impacts a surface in the manner shown in FIG. 5. Due to the cutter teeth 86 lying in a plane laterally offset of the bore contact area 88*b*, a moment arm is exerted about 88*b* to tilt the cutter element 74*a* in the direction opposite to that of FIG. 6 and thus effect a lateral movement in a cutter tooth 86 in the direction of arrow 114. As a result, the forces imparted by the cutter teeth 86 onto the surface 98 have both a downward and horizontal component.

It is believed to be this lateral sideways movement of the cutter teeth which substantially improves the efficiency of this type of cutter element compared to those of the prior art. In tests conducted on concrete, the effectiveness of the star-shaped cutter teeth having a dish shaped of FIG. 6, have at least a five-fold and in some instances eight-fold increase in effectiveness in removing a concrete surface layer compared to the standard star-shaped cutter elements of the prior art patents such as U.S. Pat. No. 4,275,928 and U.S. Pat. No. 3,156,231. At these high speeds it is difficult to ascertain how the lateral movement in the cutter teeth accomplishes this significant improvement. It is theorized, however, that the lateral movement of the cutter teeth improve the chipping action due to the fact that concrete has resistance to breakage in the compressive direction approximately ten times greater than its resistance to breakage in the tensile direction. It is believed that the lateral movement of the cutter teeth 86 in producing a horizontal component of force take advantage of the weaker tensile strength of the concrete compared to its compressive strength. The cutter elements in accordance with this invention in having a concave or dished shape provide the means for effecting lateral movement of the cutter teeth on impacting the surface. It is appreciated that the degree of concavity in each cutter element has to be within a certain angular range in order to effect this kick-over action of the cutters. The angle between cutter tooth faces 86*a* and 86*b* may range from 90° to 150°. The preferred angle is approximately 120°. Once the cutter element leaves the surface being treated, centrifugal force in essence resets the cutter to the opposite angle, as shown in FIG. 6, to optimize on the extent of cutter tooth movement 86 in the direction of arrow 114 of FIG. 7.

With the remaining cutter elements illustrated in FIGS. 8 through 13, various arrangements are provided on the cutters to effect this lateral movement in the cutter teeth when impacting the surface being treated.

Figure 8:
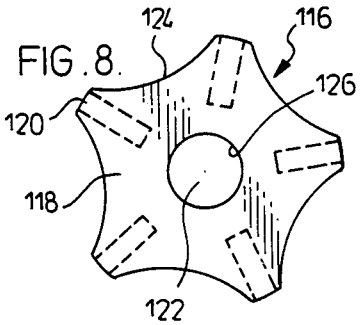
FIG. 8 illustrates another embodiment for the cutter element.
Figure 9:
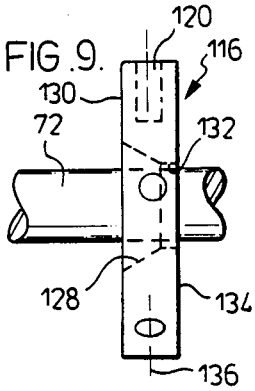
FIGS. 9 and 10 show the respective rest and cutting action positions of the cutter element of FIG. 8.
Figure 10:
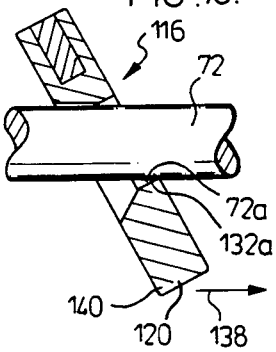

With the cutter elements of FIGS. 8, 9 and 10, the cutter element 116 consists of a body portion 118 having embedded therein carbide tips 120 symmetrically spaced about the central axis 122 of the cutter element. The body portion 118 is scalloped at areas 124 between adjacent carbide tips to provide for wear on the carbide tips. A bore 126 extends through the body portion 118 of the cutter element 116 as shown in FIG. 9. The bore 126 consists of a countersunk tapered portion 128 opening to one side 130 of the cutter element The countersunk portion 128 extends across the major portion of the bore leaving a minor portion 132 opening to the other side 134 of the cutter element. The carbide tipped teeth 120 all lie generally in the same plane indicated by dotted line 136. The plane of the cutter teeth is laterally offset of the minor cylindrical portion 132. The body portion of the cutter element 116 is considerably heavier than the thinner plate portion of the cutter element 74. Due to the lateral offset of the plane 136 of the cutter teeth relative to the contact area of the cutter bore 132 against the bar 72, centrifugal forces acting on the cutter elements cause them to tilt generally in the direction indicated in FIG. 10. As previously explained, at high speed rotations of these cutter elements, it is difficult to ascertain exactly what action occurs in the cutter teeth. However, it is theorized that on impact the cutter elements are tilted further in the direction of arrow 138 on the carrier bar 72 between the contact point 72*a* of the carrier bar and 132*a* of the cutter bore. This tilting action is evidenced by wear patterns on the cutter teeth where the softer metal in the area 140 is worn off to expose the edge of the carbide tips 120. Therefore, in the manner discussed in shaping the cutter bore, means is provided for effecting a lateral movement in the direction of arrow 138 for the cutter teeth to take advantage of the weaker tensile strength of the concrete for purposes of removing a layer of concrete from the surface of the solid substrate.

Figure 11:
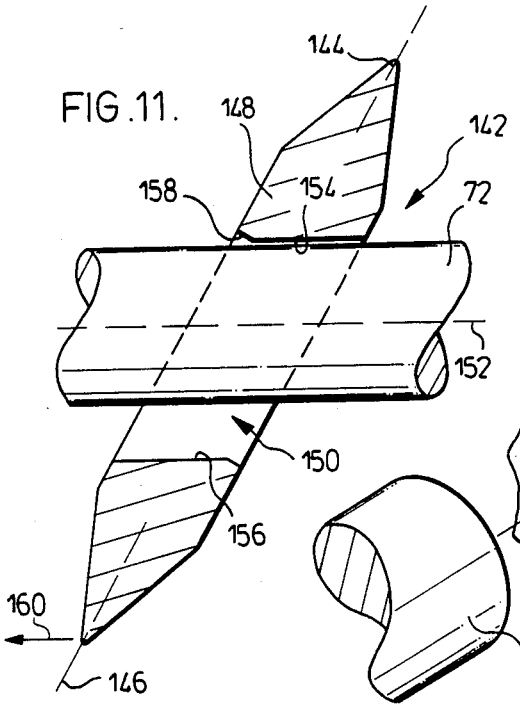
FIGS. 11 and 12 illustrate an alternative embodiment for the bore extending through the cutter element to effect the lateral movement in the cutter when impacting a surface.
Figure 12:
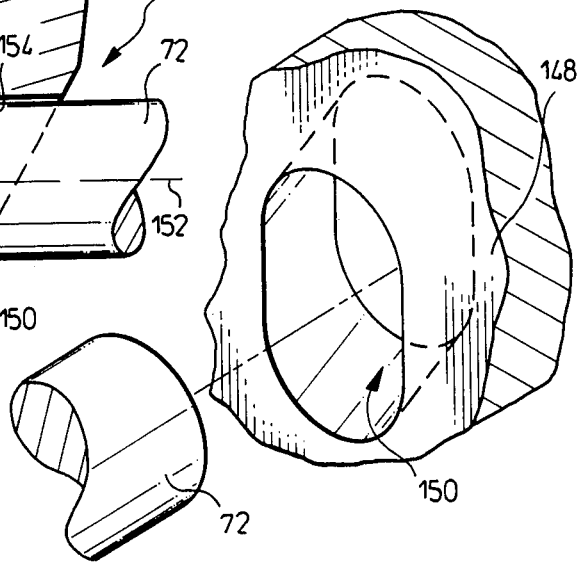

In FIGS. 11 and 12, another embodiment for the bore configuration of the cutter elements for effecting lateral movement of the cutter teeth on impact with the surface is illustrated. The cutter element 142 has a plurality of cutter teeth 144 about its periphery and all lying in the same plane generally indicated by dotted line 146. The cutter teeth 144 are carried on spikes about the perimeter of the cutter element 142. The body portion 148 for the cutter element includes a bore generally designated 150 for mounting on the carrier bar 72. The bore 150, formed in the body portion 148 of the cutter element, has an axis 152 which is tilted relative to the plane 144 within which the cutter teeth 144 lie. The bore 150 is oblong as shown in FIG. 12 and has upper and lower bore surfaces 154 and 156. In use, the edge portion 158 of the bore face 154 is initially in contact with the carrier bar 72 due to the centrifugal forces. The cutter element is encouraged to tilt in the direction shown in FIG. 11 and on impact tilt further to the position shown in FIG. 11. Once the cutter is in contact with the surface, rotation is induced in the cutter 142 about the bar 72. Due to the tilted orientation of the bore 150, the cutter tends to wobble as it rotates about the bar. This wobble action enhances the chipping effect of the teeth on the surface as the teeth move laterally. In addition, as the cutter rotates, pressure of the teeth on the surface is cyclically increased due to the oblong shape of the bore 150. This action further enhances the cutter efficiency.

Figure 13:
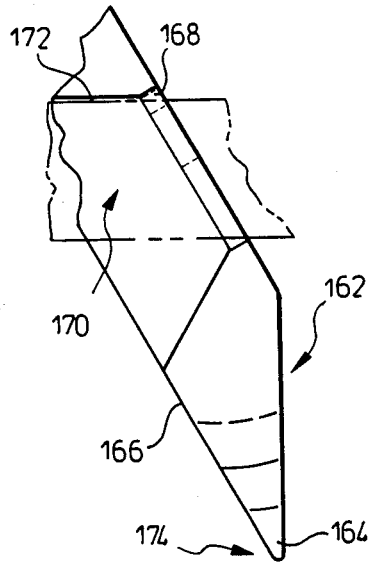
FIG. 13 illustrates an alternative cutter tooth arrangement for the cutter elements.

FIG. 13 illustrates an alternative arrangement for the cutter teeth on a cutter element 162. The cutter teeth 164 lie in a plane adjacent a face 166 of the cutter element which is offset from the minor cylindrical portion 168 of the bore 170. The bore 170 also includes a tapered countersunk portion 172 which provides an arrangement similar to the bore 126 of cutter element 116 shown in FIG. 8. As with the action of the cutter element demonstrated in FIG. 10, similarly the bore 170 effects a lateral movement of the cutter teeth 164 in the direction of arrow 174. The cutter teeth 164 are at the end of spike portions similar to those of FIG. 11. Therefore, with the embodiments of FIGS. 8, 11 and 13, by way of shaping the bore for the cutter elements, the lateral movement in the cutter teeth of each cutter element during impact with the surface being treated significantly improves the material removal by the chipping action of the teeth.

In order to provide for even wear on the cutters, they are allowed to rotate on the carrier bar to avoid the same teeth always impacting the surface and wearing the cutter down in one area more than the other. It has been found that in treating concrete surfaces, this lateral motion in the cutter teeth provides a smoother finish for the treated surface than the normal planar types of cutter elements which vertically impact the surface being treated. Furthermore, it has been found that the cutter elements last considerably longer although they achieve superior results concerning the amount of material removed during a comparable timeframe for both the prior art types of cutters and the cutters according to this invention. It is theorized that by using the cutters according to this invention which tend to attack the surface being treated at an angle, takes advantage of the weaker tensile strength of the material being treated, such as concrete, to provide a superior rate of material removal.

The cutter elements may include carbide bits embedded therein or may be formed of metal which has hardened tips. For example, the star-shaped cutters of FIG. 2 may be formed from plate steel with the star-shaped cut out and subsequently dished to form the concaved cross section. The selected steel may be a high carbon steel such as C-1075 and hardened to a Rockwell hardness of up to C60. The concavity in the plate may be formed by a progressive die working on the blank plate portion. The shaped cutter is then hardened to the desired hardness. The carbide tip cutters may have their body portion formed by stamping them from metal or formed by investment casting with carbide tips in place in the mold. In forming the wall portion in the carbide tip cutters such as in FIG. 8, it is preferable to leave the small cylindrical shoulder 132 which has better wear characteristics than the arrangement of the conical portion 128 extending all the way out to the other side 144 of cutter body portion. The cutter body portion may be formed from a "Super Impacto"(trademark) metal sold by Atlas Steels of Toronto, Canada. In forming the bore, the desired angle of the conical portion of the bore or the plane of tilt of the cutter teeth relative to the central axis of the carrier bar or collar may range from 5° to 75°. Although improved working characteristics are achieved when the angle varies from 10° to 60°, and preferably from 15° to 45°.

The O-ring spacers used with the cutter element 74 of FIG. 2 may be formed of spring wire which have an overall external diameter less than the height of the body portion of the cutter element to enable the cutters to oscillate during use of the cutter elements.

While preferred embodiments have been described and illustrated herein, a person skilled in the art will appreciate that changes and modifications may be made thereto without departing from the spirit and scope of this invention as defined in the appended claims.

The embodiments of the invention in which an exclusive property or privilege is claimed are defined as follows:

1. In an apparatus for removing material from the surface of a solid substrate comprising a support frame, a rotary cutter cage, means for mounting said rotary cutter cage on said support frame, means for rotating said rotary cutter cage about a central axis, said rotary cutter cage having at least one row of a plurality of cutters mounted thereon for impacting a solid substrate, said at least one row of cutters being mounted on a bar connected to said rotary cage, each cutter having a body portion with a bore extending therethrough to receive and be mounted on said bar, said bar being spaced from and parallel to said central axis, each of said cutters having a plurality of projecting cutter teeth, the improvement comprising means on each said cutter for forcing a lateral movement in said cutter teeth in a direction generally along said bar when said cutters impact a solid substrate being treated during rotation of said rotary cutter cage in use of said apparatus, said means for forcing said lateral movement comprising a contact point in said bore of each said cutter which contacts said bar and about which said cutter pivots as said cutter teeth move laterally and said cutter teeth of each said cutter lie in a plane offset laterally of said contact point in said bore.

2. In an apparatus for removing material from the surface of a solid substrate comprising a support frame, a rotary cutter cage, means for mounting said rotary cutter cage on said support frame, means for rotating said rotary cutter cage about a central axis, said rotary cutter cage having at least one row of a plurality of cutters mounted thereon for impacting a solid substrate, said at least one row of cutters being mounted on a bar connected to said rotary cage, said bar being spaced from and parallel to said central axis, each of said cutters having a plurality of projecting cutter teeth, and said cutters being mounted loosely on said bar the improvement comprising means on each said cutter for forcing a lateral movement in said cutter teeth in a direction gen®rally along said bar when said cutters impact a solid substrate being treated during rotation of said rotary cutter cage in use of said apparatus, said means for forcing said lateral movement comprising a bore formed centrally of each said cutter with said cutter being concave in shape, each said cutter bore being larger than said bar to mount loosely said cutter on said bar, the concave shape of said cutter effecting lateral movement of said cutter teeth when impacting a solid substrate being treated.

3. In an apparatus of claim 2, said cutter being a generally circular plate which in diametrical cross-section is concave, said cutter teeth being formed in said plate and extending outwardly to define a concave star-shaped cutter.

4. In an apparatus of claim 3, said cutter teeth being of hardened steel.

5. In an apparatus of claim 6, said rotary cutter cage having circular end plates to which at least one pair of diametrically opposing bars are mounted, each bar being circular in cross-section and carrying a plurality of said star-shaped cutters, a spacer ring being provided between adjacent cutters on said bar, the number of cutters on said bar being such to permit said lateral movement of said cutter teeth.

6. In an apparatus of claim 5, said spacer ring being a metal 0-ring of a width and internal diameter which precludes one of said cutters interfering with a tilting movement of an adjacent said cutter during said lateral movment of said cutter teeth.

7. In an apparatus for removing material from the surface of a solid substrate comprising a support frame, a rotary cutter cage, means for mounting said rotary cutter cage on said support frame, means for rotating said rotary cutter cage about a central axis, said rotary cutter cage having at least one row of a plurality of cutters mounted thereon for impacting a solid substrate, said at least one row of cutters being mounted on a bar connected to said rotary cage, said bar being spaced from and parallel to said central axis, each of said cutters having a plurality of projecting cutter teeth, and said cutters being mounted loosely on said bar the improvement comprising means on each said cutter for forcing a lateral movement in said cutter teeth in a direction generally along said bar when said cutters impact a solid substrate being treated during rotation of said rotary cutter cage in use of said apparatus, said means for forcing said lateral movement comprising a bore formed centrally of each said cutter, said bore being larger than said bar to mount loosely said cutter on said bar, said bore having a tapered countersunk portion extending along a majority of and opening outwardly of said bore, said countersunk portion effecting lateral movement of said cutter teeth when impacting a solid substrate being treated.

8. In an apparatus of claim 7, a plurality of said cutters being placed on said bar to provide a set of cutters, said countersunk portions of said set of cutters all opening out in the same direction, said bore having a minor cylindrical wall portion adjacent said countersunk portion, a central plane extending through said cutter and in which said cutter teeth lie, each said cutter pivoting on said minor cylindrical wall portion which is laterally offset of said central plane whereby impacting said cutter on a solid substrate during rotation of said cutter cage forces said cutter teeth to move laterally due to interaction of said bore countersunk portion and said bar.

9. In an apparatus of claim 8, wherein said cutter teeth are of hardened steel, said cutter having a body portion into which said cutter teeth are embedded, said cutter teeth being symmetrically arranged about said cutter bore, said body portion being formed of a material which is softer than said hardened steel teeth.

10. In an apparatus of claim 9, wherein said body portion is essentially cylindrical and having a peripheral face, said cutter teeth being embedded in said peripheral face of said body portion, said teeth being equally spaced about the peripheral face, said cylindrical body portion being scalloped between adjacent teeth.

11. In an apparatus of claim 8, said rotary cutter cage having circular end plates to which at least one pair of diametrically opposing bars are mounted, each bar being circular in cross-section and carrying a plurality of said cutters, the number of cutters on said bar being such to permit said lateral movement of said cutter teeth.

12. In an apparatus of claim 8, wherein said cutter has a hub and a plurality of spikes extending radially outwardly thereof, said spikes having hardened tips to form said cutter teeth.

13. In an apparatus for removing material from the surface of a solid substrate comprising a support frame, a rotary cutter cage, means for mounting said rotary cutter cage on said support frame, means for rotating said rotary cutter cage about a central axis, said rotary cutter cage having at least one row of a plurality of cutters mounted thereon for impacting a solid substrate, said at least one row of cutters being mounted on a bar connected to said rotary cage, said bar being spaced from and parallel to said central axis, each of said cutters having a plurality of projecting cutter teeth, and said cutters being mounted loosely on said bar the improvement comprising means on each said cutter for forcing a lateral movement in said cutter teeth in a direction generally along said bar when said cutters impact a solid substrate being treated during rotating of said rotary cutter cage in use of said apparatus, said cutter teeth of each said cutter all lying generally in the same plane where said cutter teeth define a circle having a centre, said cutter having a central axis which extends through said centre and which extends perpendicularly to said plane defined by said teeth, said means for forcing said lateral movement comprising a bore formed centrally of each said cutter, said bore being larger than said bar to mount loosely said cutter on said bar, said bore extending along an axis which is tilted relative to said central axis of said cutter, said tilted cutter bore effecting lateral movement of said cutter teeth when impacting a solid substrate being treated.

14. In an apparatus of claim 13, said plane extending centrally through said cutter.

15. In an apparatus of claim 14, said rotary cutter cage having circular end plates to which at least one pair of diametrically opposing bars are mounted, each bar being circular in cross-section and carrying a plurality of said cutters, the number of cutters on said bar being such to permit said lateral movement of said cutter teeth.

* * * * *

UNITED STATES PATENT AND TRADEMARK OFFICE

CERTIFICATE OF CORRECTION

PATENT NO. : 4,725,097

DATED : February 16, 1988

INVENTOR(S) : Frank Zelenka

It is certified that error appears in the above-identified patent and that said Letters Patent is hereby corrected as shown below:

In claim 5, column 9, line 6, "claim 6" should read --claim 3--.

Signed and Sealed this

Twenty-sixth Day of December, 1989

*Attest:*

JEFFREY M. SAMUELS

*Attesting Officer*

*Acting Commissioner of Patents and Trademarks*